US010393464B2

(12) United States Patent
Turlakov

(10) Patent No.: US 10,393,464 B2
(45) Date of Patent: Aug. 27, 2019

(54) GUN WITH REMOVABLE BARREL

(71) Applicant: RITTER & STARK GMBH, Feistritz im Rosental (AT)

(72) Inventor: Maxim Turlakov, Ferlach (AT)

(73) Assignee: RITTER & STARK GMBH, Feistritz im Rosental (AT)

( * ) Notice: Subject to any disclaimer, the term of this patent is extended or adjusted under 35 U.S.C. 154(b) by 0 days.

(21) Appl. No.: 16/090,265

(22) PCT Filed: Mar. 30, 2017

(86) PCT No.: PCT/EP2017/057615

§ 371 (c)(1),
(2) Date: Sep. 30, 2018

(87) PCT Pub. No.: WO2017/167924

PCT Pub. Date: Oct. 5, 2017

(65) Prior Publication Data

US 2019/0113297 A1 Apr. 18, 2019

(30) Foreign Application Priority Data

Mar. 30, 2016 (WO) ..... PCT/AT2016/000030

(51) Int. Cl.
*F41C 23/16* (2006.01)
*F41A 21/48* (2006.01)
*F41G 11/00* (2006.01)

(52) U.S. Cl.
CPC ..... *F41A 21/485* (2013.01); *F41A 21/487* (2013.01); *F41G 11/003* (2013.01)

(58) Field of Classification Search
CPC ..... F41C 23/16; F41G 11/003; F41A 21/482; F41A 21/485; F41A 21/487; F41A 3/66
(Continued)

(56) References Cited

U.S. PATENT DOCUMENTS 3,731,418 A * 5/1973 Birkenhagen ..... F41A 21/481 42/75.02
5,706,599 A 1/1998 Knight
(Continued)

FOREIGN PATENT DOCUMENTS

DE 102009051416 A1 7/2010
RU 2588922 C2 7/2016

OTHER PUBLICATIONS

International Search Report issued by the European Patent Office International Searching Authority. Application No. PCT/EP2017/057615, dated Jul. 6, 2017. 2 pages.
(Continued)

*Primary Examiner* — Michael D David
(74) *Attorney, Agent, or Firm* — Meunier Carlin & Curfman LLC

(57) ABSTRACT

The present invention relates to a gun with a removable barrel, the barrel having a mounting rail connected to it and extending in the direction of the longitudinal barrel axis A, the barrel being connected to the system housing by means of a receptacle on the system housing, the receptacle being tubular at least partially in the direction of the longitudinal barrel axis A and the corresponding inner tube diameter dl being adapted to the outer circumference of the barrel, so that the barrel can be introduced into the receptacle in the direction of the longitudinal barrel axis A when the barrel is mounted on the system housing, and wherein the receptacle has a recess of the tube circumference which extends in the direction of the longitudinal barrel axis A, wherein the barrel is fixed axially with respect to the longitudinal barrel axis A by at least one connecting element and is fixed with respect to rotation at least in that the mounting rail extends in its longitudinal direction at least partially within the recess of the receptacle.

19 Claims, 11 Drawing Sheets

Figure 1A:
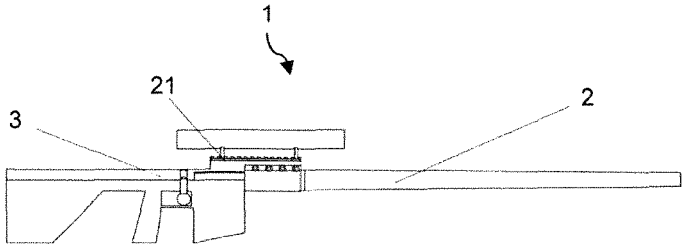

(58) Field of Classification Search
USPC ..... 42/75.01–75.1
See application file for complete search history.

(56) References Cited

U.S. PATENT DOCUMENTS

| | | | | |
|---|---|---|---|---|
| 6,293,040 | B1 * | 9/2001 | Luth | F41A 11/02 42/75.01 |
| 6,671,990 | B1 | 1/2004 | Booth | |
| 7,313,883 | B2 * | 1/2008 | Leitner-Wise | F41A 3/66 42/75.02 |
| 7,451,564 | B2 * | 11/2008 | Wait | F41A 21/482 42/75.02 |
| 7,707,762 | B1 * | 5/2010 | Swan | F41G 11/003 42/105 |
| 7,770,317 | B1 * | 8/2010 | Tankersley | F41C 23/16 42/71.01 |
| 7,905,041 | B1 * | 3/2011 | Davies | F41A 3/66 42/75.02 |
| 8,037,633 | B1 * | 10/2011 | Troy | F41C 23/16 42/71.01 |
| 8,046,949 | B1 * | 11/2011 | Daniel | F41C 23/16 42/71.01 |
| 8,087,194 | B1 * | 1/2012 | Vuksanovich | F41A 21/48 42/75.01 |
| 8,141,285 | B2 * | 3/2012 | Brown | F41A 3/66 42/71.01 |
| 8,276,304 | B2 * | 10/2012 | Samson | F41C 23/16 42/112 |
| 8,336,243 | B2 * | 12/2012 | Langevin | F41C 23/16 42/71.01 |
| 8,359,779 | B2 * | 1/2013 | Daniel | F41C 23/16 42/71.01 |
| 8,453,364 | B2 * | 6/2013 | Kucynko | F41C 23/16 42/71.01 |
| 8,464,457 | B2 * | 6/2013 | Troy | F41G 11/003 42/71.01 |
| 8,479,429 | B2 * | 7/2013 | Barrett | F41A 3/26 42/75.02 |
| 8,490,312 | B2 * | 7/2013 | Barrett | F41A 3/26 42/75.02 |
| 8,505,227 | B2 * | 8/2013 | Barrett | F41A 3/26 42/75.02 |
| 8,561,337 | B2 * | 10/2013 | Lewis | F41A 3/26 42/73 |
| 8,595,970 | B2 * | 12/2013 | Picciotta | F41C 23/16 29/525.01 |
| 8,640,372 | B2 * | 2/2014 | Hochstrate | F41A 5/18 42/111 |
| 8,714,144 | B2 * | 5/2014 | Zadra | F41A 11/02 124/74 |
| 8,782,943 | B2 * | 7/2014 | Jarboe | F41A 21/485 42/75.02 |
| 8,806,793 | B2 * | 8/2014 | Daniel | F41C 23/16 42/72 |
| 8,863,426 | B1 * | 10/2014 | Zinsner | F41C 23/16 42/71.01 |
| 9,057,576 | B2 * | 6/2015 | Barrett | F41A 3/66 |
| 9,127,906 | B2 * | 9/2015 | Wells | F41G 11/003 |
| 9,322,611 | B1 * | 4/2016 | Barfoot | F41A 21/48 |
| 9,383,154 | B2 * | 7/2016 | Stone | F41A 21/481 |
| 9,429,387 | B1 * | 8/2016 | Barfoot | F41C 23/16 |
| 9,448,027 | B1 * | 9/2016 | Zinsner | F41A 21/482 |
| 9,476,672 | B2 * | 10/2016 | Wells | F41C 23/16 |
| 9,506,711 | B2 * | 11/2016 | Gomez | F41A 21/48 |
| 9,772,150 | B2 * | 9/2017 | Gomez | F41A 21/487 |
| 9,816,546 | B2 * | 11/2017 | Gomez | F41A 21/48 |
| 10,107,582 | B2 * | 10/2018 | Gray | F41A 21/482 |
| 10,240,883 | B2 * | 3/2019 | Gomez | F41A 21/48 |

OTHER PUBLICATIONS

International Search Report and Written Opinion issued by the European Patent Office International Searching Authority. Application No. PCT/EP2017/057615, dated Jul. 6, 2017. 8 pages.

* cited by examiner

GUN WITH REMOVABLE BARREL

The present invention relates to a gun with a removable barrel which has a mounting rail connected to it and extending in the direction of the longitudinal barrel axis, which is suitable, for example, for mounting an optical sight, which has an advantageous mounting device on the system housing for the barrel, as a result of which the invention can be used in particular in the field of firearms with interchangeable barrels.

Guns with interchangeable barrels are known to have the target optics mounted on a separate component between the system housing and the barrel, the so-called barrel extension. With these guns, however, the target optics must be recalibrated each time the barrel is changed.

A known mounting device for interchangeable barrels is a clamping device, by means of which the barrel can be mounted directly on the system housing. This avoids the need for the barrel extension as an additional component. Such a gun is described, for example, in RU 2303227 C1. However, with these firearms it is not possible to mount an optical targeting device in the area of the cartridge magazine directly on the barrel. Here, too, the exact retention between the barrel axis and the optical axis of the visor must be guaranteed by a new calibration after each barrel change.

The object of this invention is therefore to provide a gun with a removable barrel, which does not have said disadvantages, in which in particular the parallelism between the barrel axis and the optical axis is maintained after the barrel change and the assembly of the barrel is particularly simple.

The problem is solved by a gun according to claim 1.

The present invention thus provides a gun with removeable barrel, which comprises a system housing and a barrel, the barrel having a mounting rail connected to it and extending in the direction of the longitudinal barrel axis, which is suitable for mounting an optical sight.

In accordance with the invention, the system housing has a receptacle by means of which the barrel is connected to the system housing, wherein the receptacle is at least partially tubular in the direction of the longitudinal barrel axis and the corresponding inner tube diameter is adapted to the outer circumference of the barrel, so that the barrel can be introduced into the receptacle in the direction of the longitudinal barrel axis when the barrel is mounted on the system housing and can be moved out of the receptacle in the direction of the longitudinal barrel axis when the barrel is disassembled.

Furthermore, according to the invention, the receptacle has a recess in the tube circumference which extends in the direction of the longitudinal barrel axis, so that the receptacle describes an open annular shape in cross-section perpendicular to the longitudinal barrel axis and in the region of the recess.

In accordance with the invention, the barrel is axially fixed with respect to the longitudinal barrel axis by at least one connecting element and rotatably fixed at least in that the mounting rail extends in its longitudinal direction at least partially within the recess of the receptacle.

The rotatory fixation works in such a way that during a rotational movement of the barrel, one of the edges of the receptacle on the recess in the direction of the longitudinal axis of the barrel abuts against one of the longitudinal flanks of the mounting rail.

In the clamping device according to the invention, the mounting rail besides its actual function also functions as a means for fixing the barrel with regard to rotation about the longitudinal barrel axis. The barrel is inserted into the clamping device or into the receiving device in such a way that the mounting rail is guided through the slot or through the recess in the clamping device until the barrel bears against the system housing. The clamping device is a component of the system housing. The gun according to the invention features a particularly simple and safe mounting device for the barrel and allows the barrel to be disassembled and re-assembled without losing the visor axis adjustment in relation to the barrel axis.

According to a preferred embodiment, the fixation with regard to rotation is additionally ensured by at least one connecting element. This provides for additional safety and stability in the construction of the mounting device.

The connecting element is preferably a screw connection. Other possible connecting elements can be, for example, pins which are secured with a split pin, but which are less reproducible and can therefore be rather disadvantageous compared to screwed connections in case of frequent barrel changes.

Furthermore, the receptacle preferably has latches on the two edges extending on the recess in the direction of the longitudinal barrel axis and pointing away from the barrel in such a way that the receptacle in the region of the latches has the shape and function of a clamp into which the barrel is clamped. The latches offer a possibility for attaching fixing devices. The clamping force can thus be transferred via the latches to the receptacle and finally to the barrel.

A first of the at least one connecting element preferably comprises a screw comprising a screw head and a threaded bolt, the bolt extending through one of the latches and through a longitudinal flank of the mounting rail into the mounting rail, the screw head abutting externally against the latches and the thread of the bolt being screwed into a counter thread inside the mounting rail. This makes it particularly easy to secure the barrel axially and rotatably with just one screw.

Preferably a second connecting element corresponding to the first connecting element is provided and is arranged opposite the first connecting element with respect to the vertical plane lying in the longitudinal barrel axis. Due to the symmetrical arrangement of the screws, one-sided deformations in the overall construction, e.g. due to material fatigue, are eliminated.

Further preferred are at least four and an even number of connecting elements, which are arranged in pairs corresponding to the first and the second connecting element. This further increases the stability, especially with regard to securing against tipping.

In accordance with a preferred embodiments, the latches of the receptacle bear in a press fit against the longitudinal flanks of the mounting rail. This represents a particularly strong connection, especially with regard to securing the barrel against rotation about its longitudinal axis.

As an alternative and also preferred, the latches of the receiver are spaced from the longitudinal flanks of the mounting rail, so that a press fit between the receiver and the barrel results only on the outer circumferential surface of the barrel. This ensures that the full clamping force is distributed particularly evenly over the outer circumference of the barrel.

According to another preferred embodiment, the at least one connecting element comprises a screw comprising a screw head and a bolt having a thread, and a counter nut, and connects two latches lying opposite one another with respect to the vertical plane lying in the barrel axis, from the latches situated on the receptacle, wherein the screw head and the counter nut each bear externally against the opposite latches and the bolt is guided through a continuous horizontal bore in the mounting rail extending perpendicularly to the direction of the longitudinal barrel axis. This largely decouples the mounting rail from the clamping force. Furthermore, elastic deformation caused by opposing screws tightened to different degrees is avoided, since the clamping force acting from the screw head on one latch is identical to the clamping force acting from the nut on the opposing latch. This increases the accuracy of the gun.

Also in this embodiment, in which the screw bolt is guided through a continuous bore in the mounting rail, the latches connected by the connecting element are preferably pressed against the longitudinal flanks of the mounting rail.

As an alternative and also preferred in this embodiment, the latches connected by the connecting element are spaced from the longitudinal flanks of the mounting rail, so that a press fit between the receptacle and the barrel results only on the outer circumferential surface of the barrel.

According to another preferred embodiment, the at least one connecting element comprises a screw comprising a screw head and a bolt having a thread, the screw head abutting the outer circumferential surface of the tubular receptacle and the bolt being radially aligned with respect to the longitudinal barrel axis and extending into the barrel through the receptacle, the counter-thread necessary for a screw connection being in the barrel. This also ensures both axial and rotational fixation of the barrel with just one screw in a particularly simple and safe manner.

In the foregoing embodiment, in which the bolt of the screw is oriented radially to the longitudinal barrel axis, there are preferably at least two connecting elements according to the at least one connecting element, which are distributed in a first plane perpendicular to the longitudinal barrel axis on the outer circumferential surface of the receptacle. This prevents elastic deformations caused by the clamping force, which helps to increase the accuracy of the gun.

Further preferably four connecting elements according to the at least one connecting element are present in the plane perpendicular to the longitudinal barrel axis, which connecting elements are distributed on the outer circumferential surface of the receptacle in such a way that each two of them lie opposite one another. This symmetrical arrangement of the screws, which are each aligned radially with respect to the longitudinal barrel axis, ensures a particularly even distribution of the clamping force and thus further increases the accuracy of the gun.

Even further preferred in the aforementioned embodiment there is at least one further plane comprising these connecting elements and lying plane-parallel to the first plane. This increases the stability considerably, in particular with regard to securing against tipping.

In the aforementioned embodiment, the edges of the receptacle extending on the recess in the direction of the longitudinal barrel axis preferably abut on the longitudinal flanks of the mounting rail. On the one hand, this facilitates the mounting of the barrel, as the bores in the tubular section of the receptacle and in the barrel are already aligned when the barrel is inserted into the mounting. In this way, the screws can be screwed in immediately, without first having to align said bores by rotating the barrel around the longitudinal barrel axis. On the other hand, this also improves the fixation of the barrel with regard to rotation around the longitudinal barrel axis.

According to another preferred embodiment, the barrel has a radially outwardly extending projection on its outer surface, and the receptacle has a thread on its tubular outer circumference at its front end portion, said thread having an internally threaded tube portion screwed thereon, which has a radially inwardly extending projection in a region at the front as viewed in the longitudinal direction of the barrel, so that the tube piece, guided over the barrel from the front, bears against the projection of the barrel and fixes the latter in the axial direction by screwing it onto the thread of the receptacle. This represents a particularly simple and effective fixation of the barrel. The at least one connecting element according to the invention thus consists only of a single tube piece, which is guided over the barrel from the front when the barrel is mounted and screwed onto the thread on the receptacle. The opening of the tube piece thus has an inner diameter that is larger than that of the barrel, except of course for the area of the barrel where the said outwardly extending projection is located. The region of the counter-thread of the tube piece has an inner diameter which is larger than the outer diameter of the barrel in the region where the said ring is located, so that the counter-thread of the tube piece can be guided over the projection of the barrel and screwed onto the thread of the receptacle. However, another region of the tube piece adjacent to the counter-thread has an inner diameter smaller than the outer diameter of the projection of the barrel. The tube piece has, so to speak, a radially inwardly extending projection which, during assembly, abuts against the radially outwardly extending projection of the barrel. Preferably, the edges of the receptacle extending on the recess in the direction of the longitudinal barrel axis in this above-mentioned embodiment bear against the longitudinal flanks of the mounting rail. This prevents the barrel from rotating about its longitudinal axis, which increases the wear resistance of the construction.

Figure 1B:
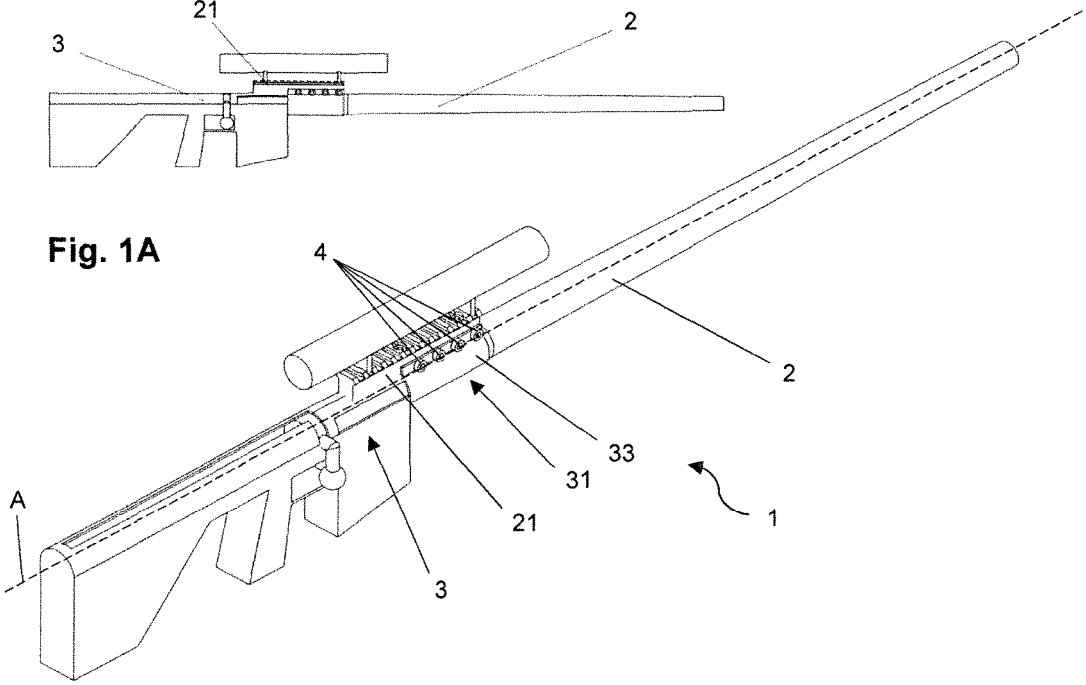
Figure 2:
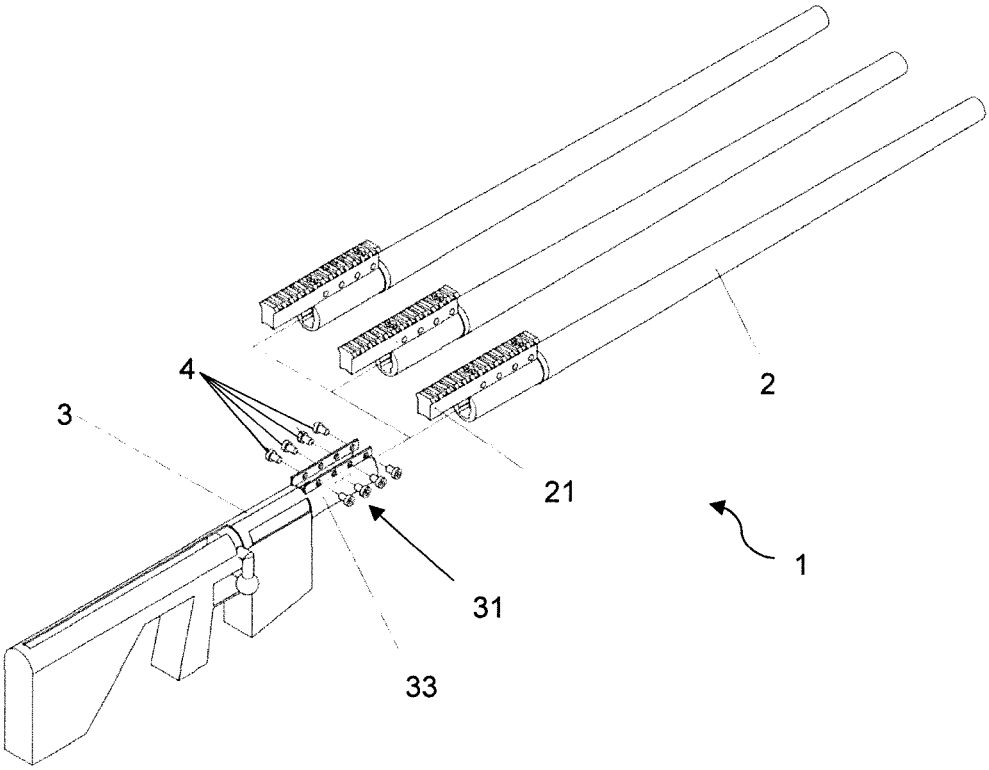
Figure 3:
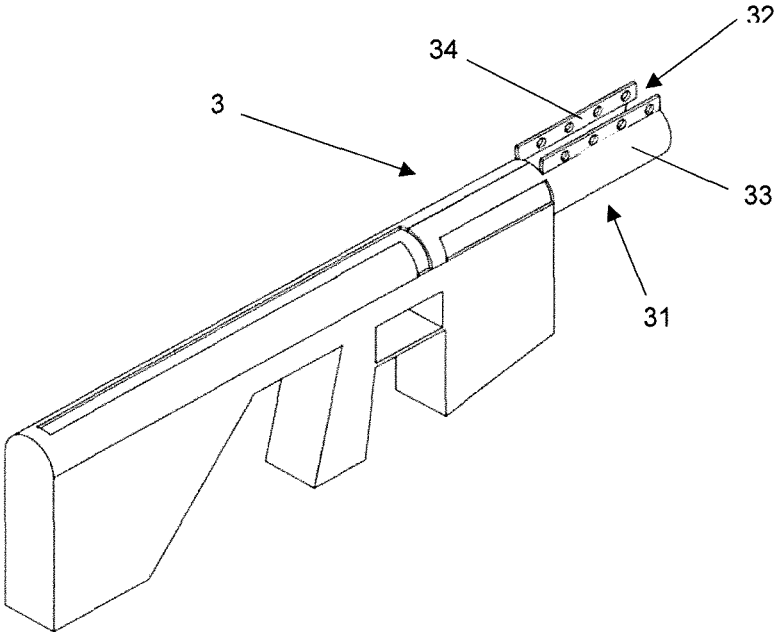
Figure 4:
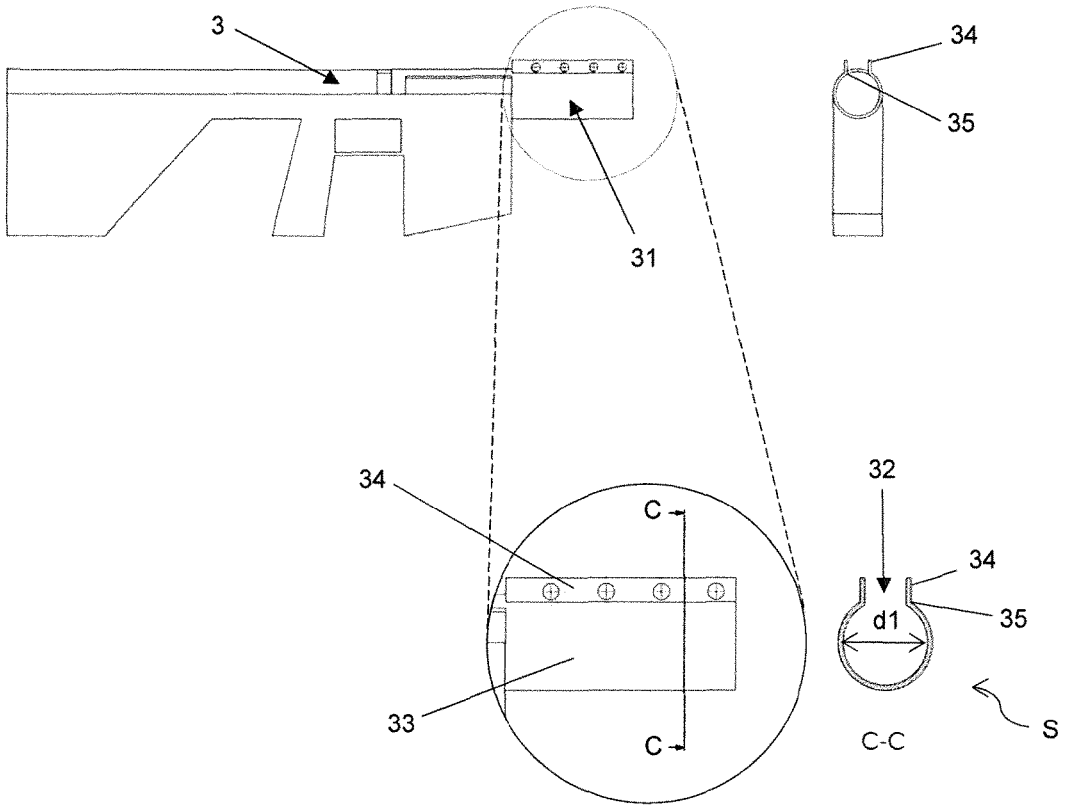
Figure 5:
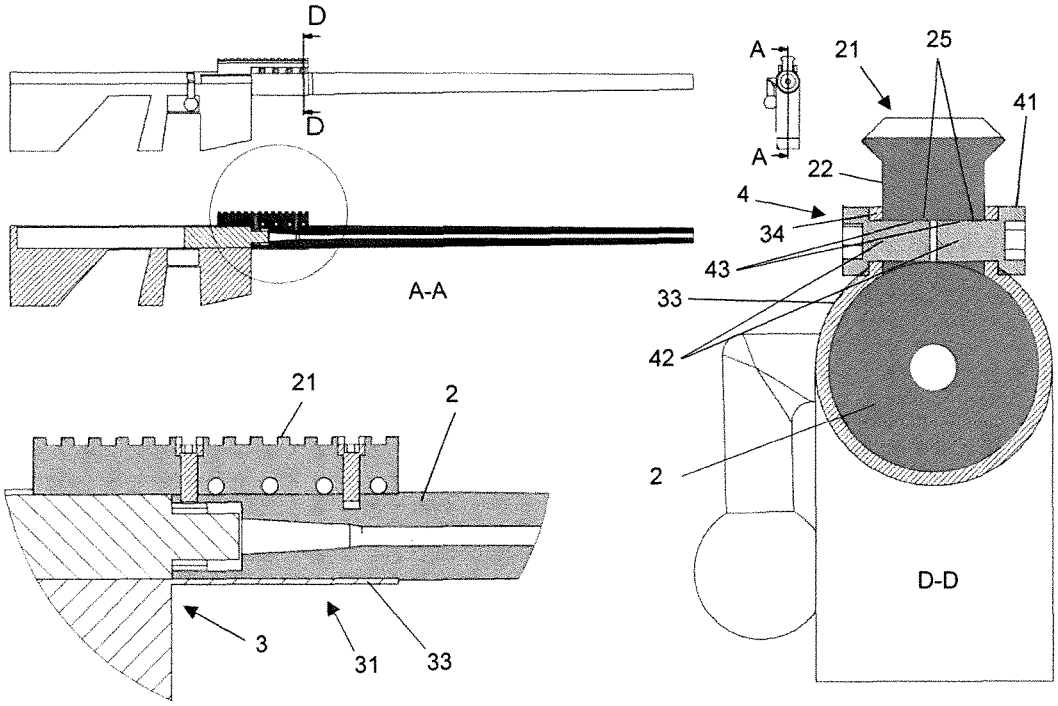
Figure 6:
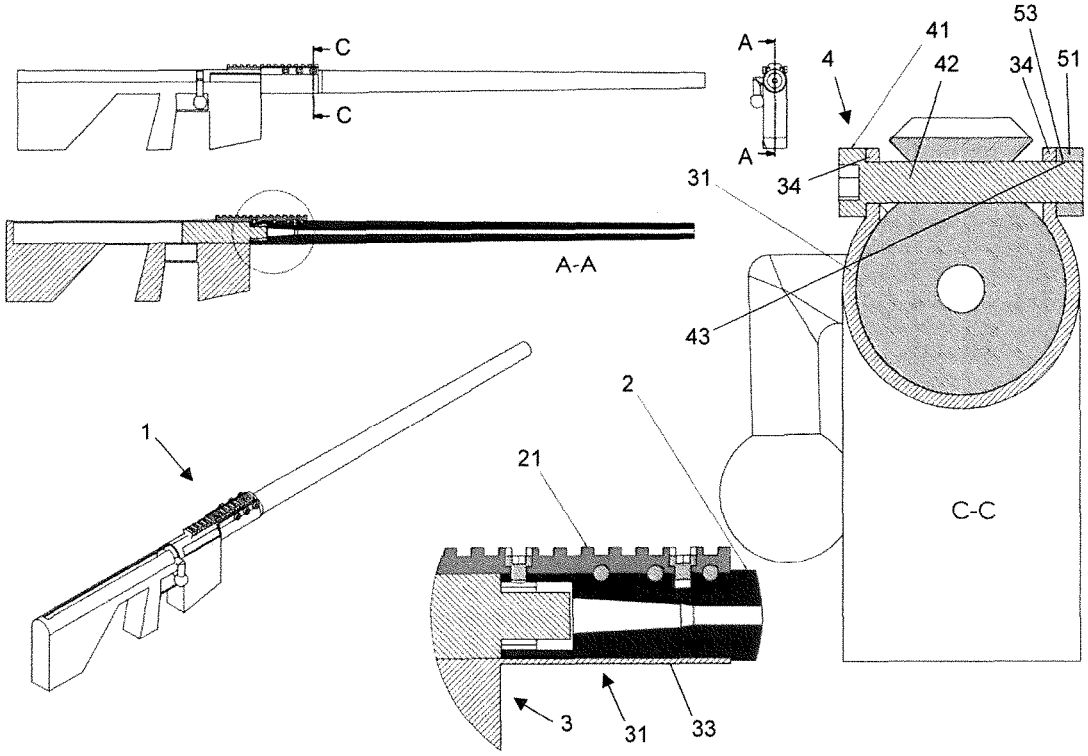
Figure 7:
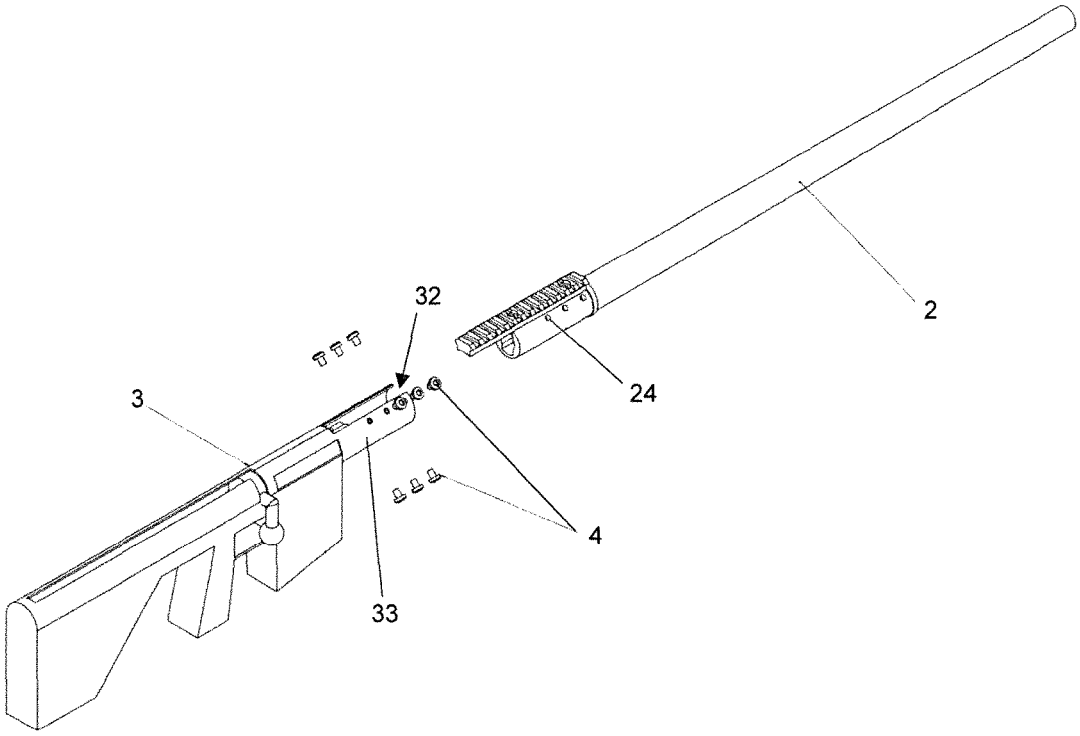
Figure 8:
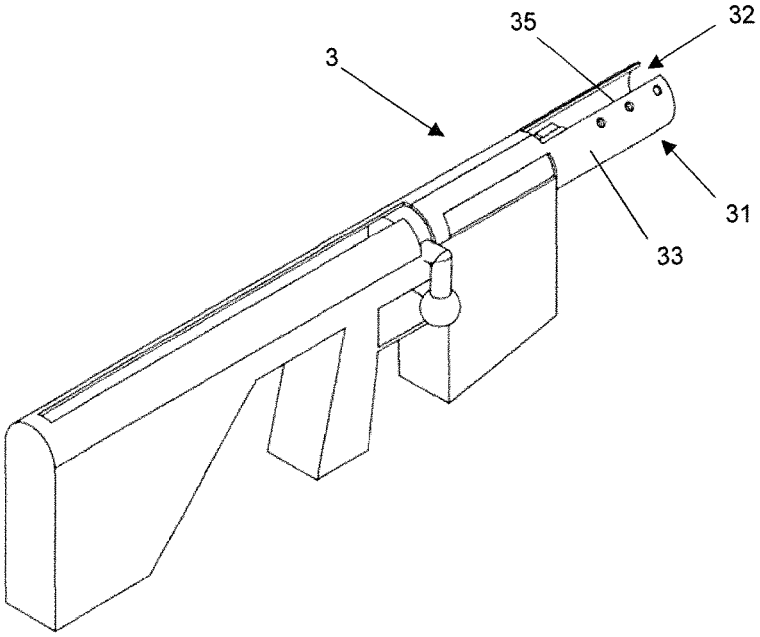
Figure 9:
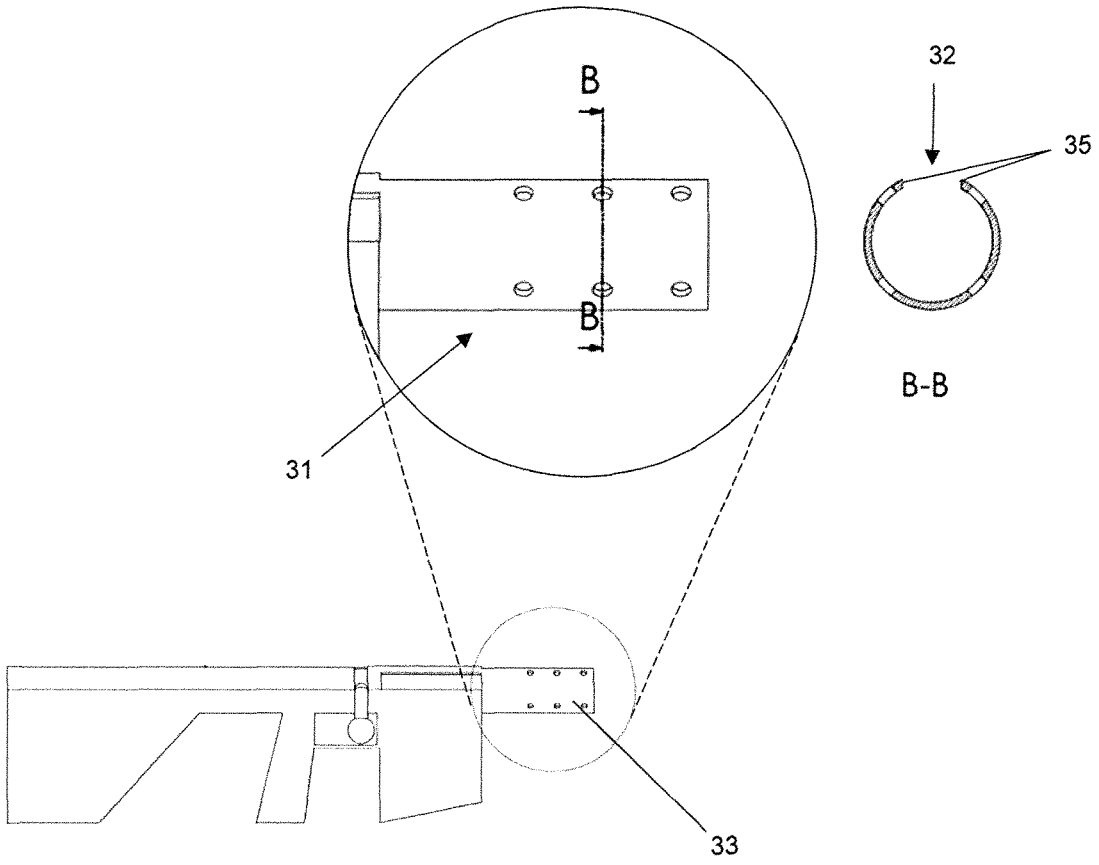
Figure 10:
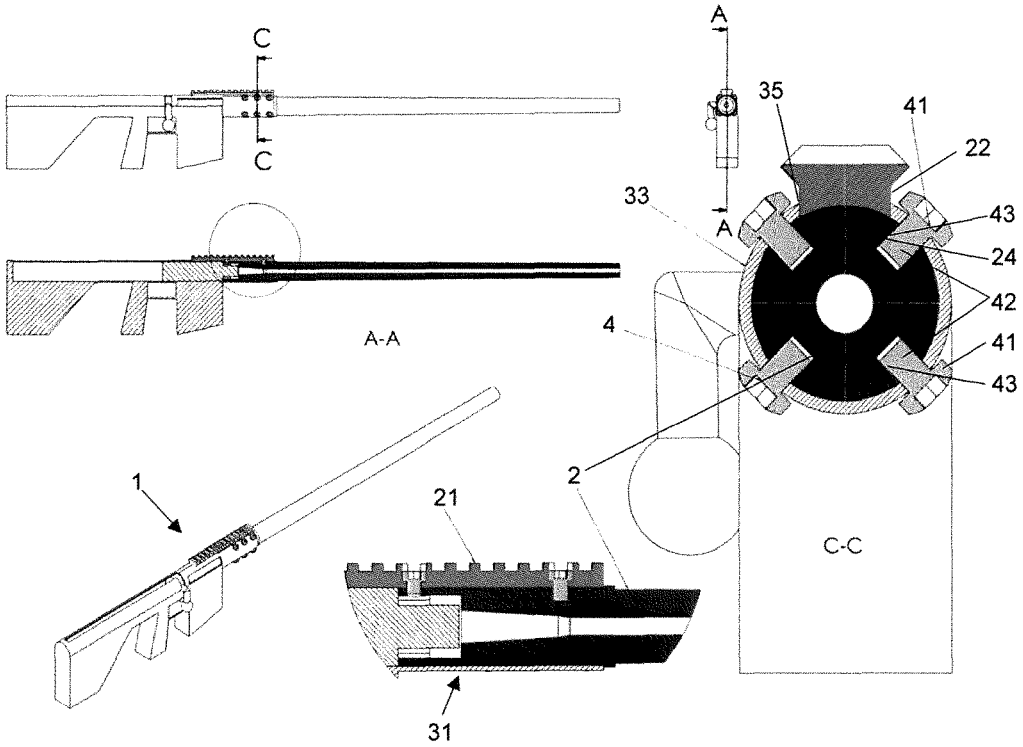
Figure 11:
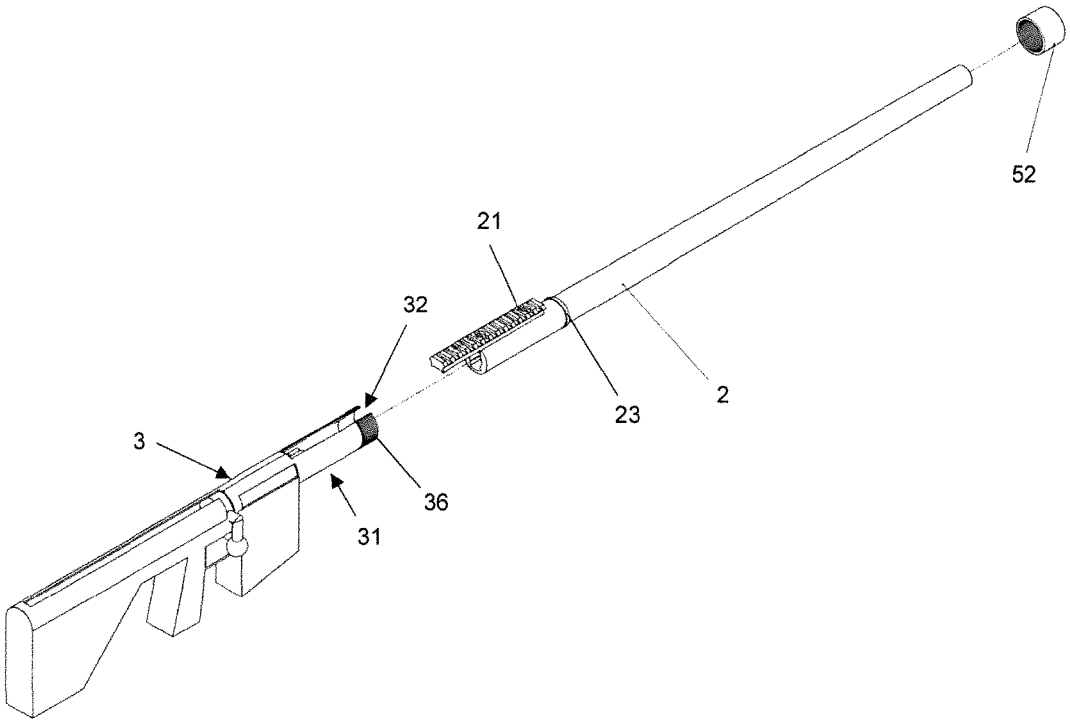
Figure 12:
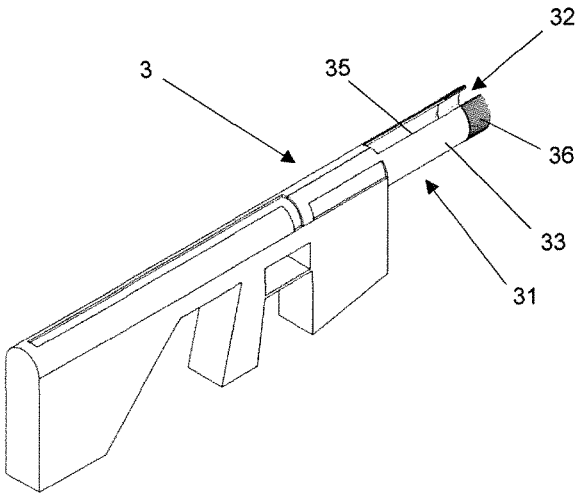
Figure 13:
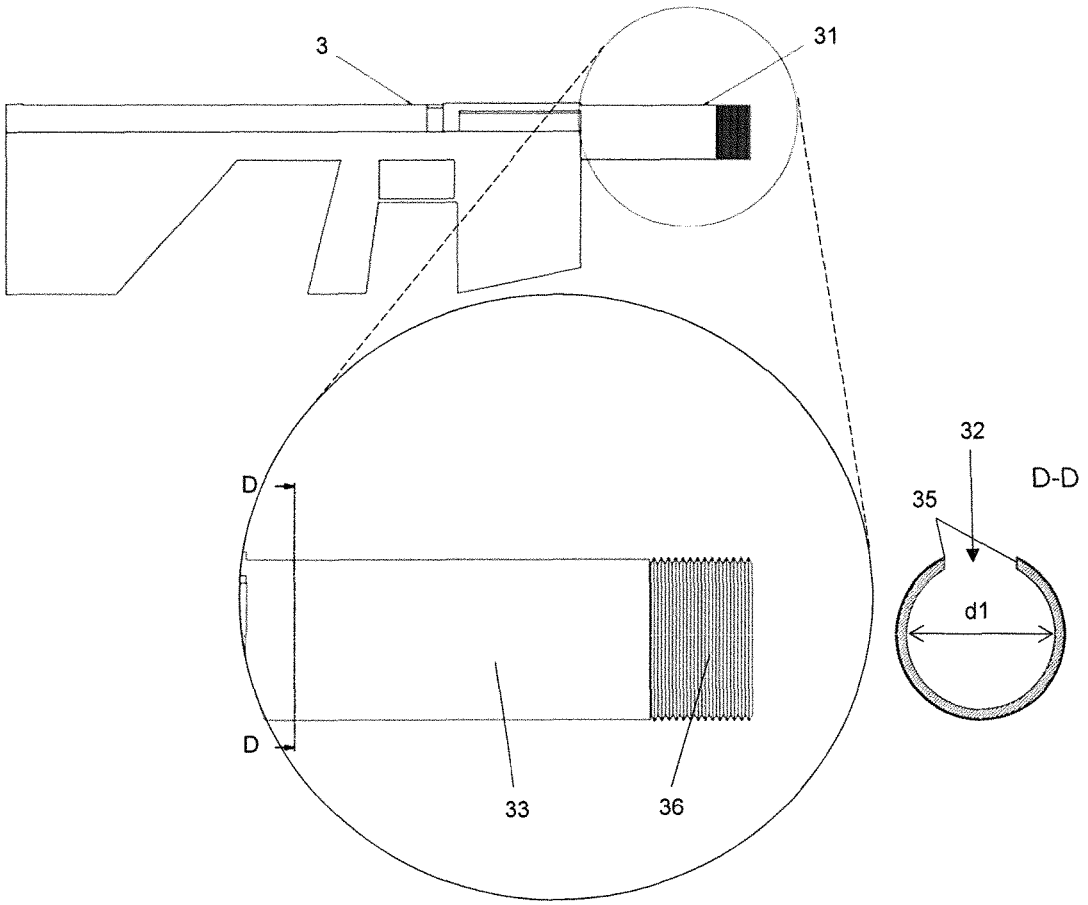
Figure 14:
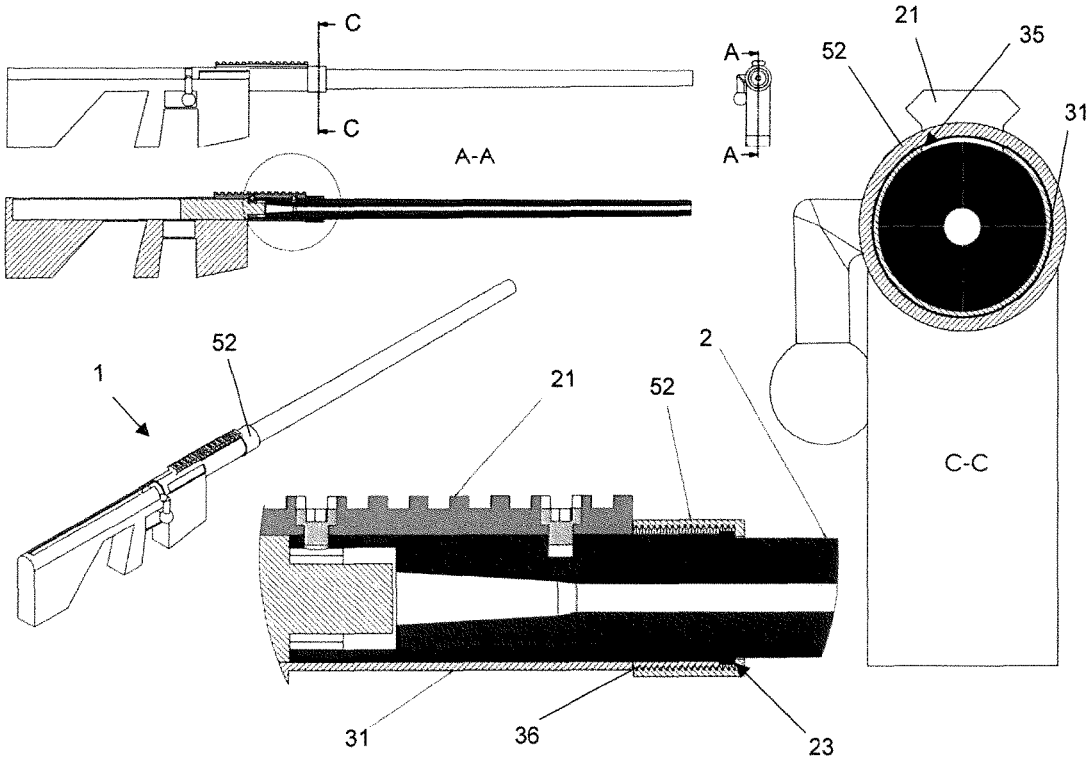

Particular embodiments of the invention are subsequently described by reference to the figures, whereby FIGS. 1A and 1B show a side view, respectively a perspective view of a gun with removable barrel according to an embodiment, FIG. 2 shows an exploded view of a gun with three interchangeable barrels according to an embodiment, FIG. 3 shows a perspective view of the system housing including a shaft according to the embodiment shown in FIG. 2, FIG. 4 shows a side view and a front view of the system housing shown in FIG. 3, as well as an enlarged section of the side view and a cross-section (C-C) of this section, FIG. 5 shows a side view and a front view of the gun shown in FIG. 2, illustrations of a cross section (D-D) and of a vertical longitudinal cross-section (A-A) as well as an enlarged section of the longitudinal cross-section, FIG. 6 shows a perspective view, a side view and a front view of a gun according to a further embodiment, illustrations of a cross-section (C-C) and of a vertical longitudinal cross-section (A-A) as well as an enlarged section of the longitudinal cross-section, FIG. 7 shows an exploded view of a gun according to another embodiment, FIG. 8 shows a perspective view of the system housing including a shaft according to the embodiment shown in FIG. 7, FIG. 9 shows a side view of the system housing shown in FIG. 8, as well as an enlarged section of it and an illustration of a cross-section (B-B) of this section, FIG. 10 shows a perspective view, a side view and a front view of the gun shown in FIG. 7, illustrations of a cross-section (C-C) and a vertical longitudinal cross-section (A-A) and an enlarged section of the longitudinal cross-section, FIG. 11 shows an exploded view of a gun according to another embodiment, FIG. 12 shows a perspective view of the system housing including a shaft according to the embodiment shown in FIG. 11, FIG. 13 shows a side view of the system housing shown in FIG. 12, as well as an enlarged section thereof and an illustration of a cross-section (D-D) of this section, and FIG. 14 shows a perspective view, a side view and a front view of the gun shown in FIG. 11, illustrations of a cross section (C-C) and a vertical longitudinal cross-section (A-A) as well as an enlarged section of the longitudinal cross-section.

The gun (1) shown in FIGS. 1A and 1B represents one embodiment of this invention. It comprises a barrel (2), a system housing (3), a mounting rail (21) and, exemplarily, an optical sight mounted on the mounting rail (21). The barrel (2) is clamped into a receptacle (31) which partially encloses the rear part of the barrel (2) and which is fixed to the mounting rail (21) in the upper region with screws (4).

The mounting rail (21), e.g. a "Picatinny Rail", can be used to mount other or additional known targeting devices and other accessory parts in addition to the optical sight. The mounting rail (21) is advantageously connected directly to the barrel (2), e.g. by means of a screw connection (see, for example, the enlarged cut-out in FIG. 5). It is also possible for the mounting rail (21) to be connected to the barrel (2) in a material-locking manner, for example by means of welding, so that the barrel (2) and the mounting rail (21) are present as an integral component. The mounting rail (21) may advantageously protrude beyond the rear end of the barrel (2), allowing sighting devices to be mounted directly above the barrel's (21) breech block area.

When mounting the gun (1) shown in FIGS. 1A and 1B, the barrel (2) with the integrated mounting rail (21), as shown in FIG. 2, is introduced with its rear end into the receptacle (31) of the system housing (3). The mounting rail (21) is thereby guided within the recess (32) provided for it in the receptacle (31) (FIG. 3). The longitudinal edges (35) (FIG. 4) of the recess (32) are provided with upwardly projecting latches (34) through which the screws (4) are screwed to the mounting rail (21). With the latches (34), the cross section of the receptacle (31) thus has the shape of a clamp (S) and functions according to the same principle.

It has to be clarified at this point that the terms 'front', 'rear', 'top', 'bottom', 'horizontal' and 'vertical' in the context of the present invention refer to the usual position of a gun during use, with the optical sight (if any) at the top, while the handle for the hand on the trigger faces substantially downwards away from the firing axis (A). The projectile finally exits the front of the gun.

According to the embodiment of FIGS. 1 to 5, the opposing latches (34) are connected to the mounting rail (21) with a total of eight screws (4) in the form of four pairs of screws, each with two screws (4) opposite each other. However, the number of screws (4) is not limited in principle. It is preferred that the screws (4) are arranged in pairs opposite each other. Particularly preferred are 2, 3, 4, 5, 6 or 7 pairs of screws. Each additional pair of screws enhances securing the gun against tipping or buckling (1). The term buckling or tipping refers to the deformation of the firearm (1), for example as a result of a radial force acting on the front end of the barrel (2) in relation to the stationary system housing (3). The latches (34) abut directly against the longitudinal flanks (22) of the mounting rail (21) and are in a press fit with them. The counter threads (25) to the screws (4) are located inside the bores provided for the screw connections in the mounting rail (21).

The size and shape of the mounting rail (21) are not particularly limited according to the invention. In a cross-section of the barrel through the mounting rail (21), the part of the outer circumference of the barrel (2) occupied by the mounting rail (21) should preferably be smaller than half the circumference of the barrel (2) to achieve improved clamping of the barrel (2). In the cross-section above the flanks (22), the mounting rail (21) may be wider than in the area of the flanks (22) and may be of any dimension depending on the type of gun and the intended accessory. All known or standardized mounting rails can be used. Examples are the Picatinny rail or the Weaver rail.

In the embodiment shown in FIGS. 1 to 5, the mounting rail (21) is clamped between the opposing latches (34). However, the clamping effect also extends over the circumference of the tubular region of the receptacle (31) within which the outer circumference of the barrel (2) is clamped. The screws (4) fix the barrel both axially and rotatably, while the mounting rail (21) additionally contributes to the rotational fixation by the fitting accuracy with which it is located in the recess (32) of the receptacle (31).

The receptacle (31) according to the invention is part of the system housing (3) and, as can be seen in FIGS. 3, 8 and 12, is preferably material-locked and continued backwards up to the area of the breech block. The material thickness in the region of the surface (33) of the tubular section of the receptacle (31) is preferably designed such that an elastic deformation is produced by the screw connection, by means of which the rear part of the barrel (2) is clamped by the tubular section of the receptacle (31).

The features of the mounting rail (21) and the receptacle (31) described above in connection with the embodiment described in FIGS. 1 to 5 may also be combined independently of each other with the other embodiments described herein, provided that this does not lead to an objective technical contradiction, and therefore form part of the general disclosure of the present invention.

FIG. 6 shows an embodiment similar to that in FIGS. 1 to 5. Here, too, the opposing latches (34) are connected with screw connections, whereby the barrel (2) is clamped. Instead of the pairs of screws, however, one screw (4) with its bolt (42) is passed completely from one latch (34) to the other latch (34) through a through-hole in the mounting rail (21) and secured on the side opposite the screw head (41) with a counter nut (51). This design ensures that the clamping forces acting on the opposing latches are identical, because the force acting on the screw head (41) corresponds to the counterforce acting on the nut. The bore inside the mounting rail (21) therefore has no counter-thread, which decouples the mounting rail (21) from the clamping force to some extent.

A further difference between the embodiment according to FIG. 6 and that of FIGS. 1 to 5 is that the latches (34) do not bear directly against the longitudinal flanks (22) of the mounting rail (21) and are therefore not in a press fit with them. This additionally decouples the mounting rail from the clamping force and thus ensures even better targeting accuracy. The clamping force thus acts practically exclusively on the outer circumferential surface of the barrel (2). However, it is also possible or preferred to design the clamping device in such a way that the bolt (42) is pressed downwards within the bore, i.e. onto the bottom of the bore, when the screw connection (4) is tightened and thus contributes directly to the clamping of the barrel. The spacing of the latches (34) from the longitudinal flanks (22) of the mounting rail (21)

further increases the freedom of design of the mounting rail (21), as the flanks (22) no longer need to be designed to accommodate the latches (34). The mounting rail (21) can therefore, for example, be flatter, as shown in the illustration of the cross-section C-C of FIG. 6 in comparison to the cross-section D-D in FIG. 5.

FIG. 6 shows three screw connections (4). The number of screws (4) is not particularly limited with this type of screw connection either. It is preferably at least two, in particular 2, 3, 4, 5, 6 or 7.

FIGS. 7 to 10 show another embodiment. This has the simplest form of the inventive receptacle (31), namely a tube with the recess (32) provided for the mounting rail (21). The cross-section (B-B) of the receptacle (31) therefore has the shape of an open ring in the area of the recess (32). Like in all embodiments, the barrel (2) is guided backwards into the mounting (31) during assembly until it abuts against the system housing (3). In this embodiment, the barrel (2) is then screwed to the receptacle (31) by screwing screws (4) through the circumferential surface (33) of the receptacle (31) into the barrel (2). The corresponding screw bolts (42) are thus radially aligned with respect to the longitudinal barrel axis (A). The corresponding counter threads (24) are located in the bores provided for the screw connections (4) in the barrel (2). Also in this embodiment the number of screws (4) is not particularly limited. For high stability and a uniformly acting clamping force, it is preferred that each screw (4) is arranged together with at least one further screw (4), in particular together with one, two, three or four further screws (4) and most preferably together with three further screws (4) in a plane perpendicular to the longitudinal direction of the barrel. It is further preferable to have at least two different planes, in particular two, three or four different planes perpendicular to the longitudinal direction of the barrel, in which at least two screws (4) are arranged as described in the previous sentence. The embodiment shown in FIGS. 7 to 10 accordingly shows three planes with four screws each.

The longitudinal edges (35) of the receptacle (31) may also be in direct contact with the flanks (22) of the mounting rail (21) as shown in FIGS. 7 to 10, or spaced from them. Both variants have their advantages, as described above.

A further embodiment of the inventive gun (1) is shown in FIGS. 11 to 14. As in the previous embodiment, the receptacle (31) is made up of only one tube section with a recess (32) provided for the mounting rail (21). The receptacle (31) has a thread (36) in a front region which encompasses the entire circumference of the tube section (with the exception, of course, of the recess). A tube piece (52) is screwed onto it in the axial direction with respect to the longitudinal barrel axis (A) after the barrel (2) has been inserted into the receptacle (31). The pipe piece (52) is guided over the barrel (2) from the front. To fix the barrel (2) axially to the system housing (3), the tube piece (52) has at least two different regions in the longitudinal direction of the barrel. The counter thread for screwing the tube piece (52) onto the receptacle (31) is provided in the rear region of the tube piece (52). In the front region, the tube piece (52) has a radially inwardly extending projection and thus a smaller inner diameter than in the rear region. The barrel (2) accordingly has a radially outwardly extending projection (23) in the region ahead of the receptacle (31), the outer diameter of which projection is larger than the inner diameter at the projection of the tube piece (52) in the front region thereof. When guiding the tube piece (52) over the barrel (2) and screwing the tube piece (52) onto the thread (36), the tube piece (52) with its "narrower" region abuts axially against the projection (23) on the barrel and thus fixes the barrel (2) to the system housing (3).

The design of the tube piece (52) is not particularly limited and may vary depending on the type and calibre of the gun (1). In particular, the length of the regions of the tube piece (52) in the axial direction, i.e. the length of the counter-thread to the thread (36) on the receptacle (31) and the length of the region with the inwardly extending projection (52) can be dimensioned independently of one another as required. The tube piece (52) may have a special shape or texture on its outer circumferential surface that improves grip. For this type of gun (1), the barrel can be changed by hand without the need for any tools such as a screwdriver or the like.

The connecting device according to FIGS. 11 to 14 is preferably designed in such a way that both the tube piece (52) and the projection (23), as well as the barrel (2) and the system housing (3) are brought together to a stop. However, it is also possible that the projection (23) on the barrel (2) is clamped by the receptacle (31) and the projection on the tube piece (52) and that the barrel (2) does not lie with the system housing (3) up to the stop. Most preferably the barrel (2) and the system housing (3) are brought together up to the stop and at the same time the projection (23) on the barrel (2) is clamped between the receptacle (31) and the tube piece (52).

The longitudinal edges (35) of the receptacle (31) may also be in direct contact with the flanks (22) of the mounting rail (21) as shown in FIGS. 11 to 14, or spaced from them. As already described, both variants have their advantages.

LIST OF REFERENCE SIGNS

1 Gun
2 Barrel
3 System housing
4 Connecting element
21 Mounting rail
22 Longitudinal flank of the mounting rail
23 Radially outwardly extending projection at the barrel
24 Thread in barrel
25 Thread within the bore in the mounting rail
31 Receptacle
32 Recess
33 Outer circumferential surface of the tubular receptacle
34 Latch
35 Edges of the receptacle extending on the recess in the direction of the longitudinal barrel axis
36 Thread on the receptacle
41 Screw head
42 Screw bolt
43 Thread on screw bolt
51 Counter nut
52 Tube piece with inner counter thread
53 Counter thread on counter nut
A Longitudinal barrel axis
d1 Inner diameter of the receptacle
S Clamp

The invention claimed is:

1. A gun with removable barrel, comprising a system housing and a barrel, the barrel having a mounting rail connected to the barrel and extending in the direction of the longitudinal barrel axis, which mounting rail is suitable for mounting an optical sight, wherein the system housing has a receptacle by means of which the barrel is connected to the system housing, wherein the receptacle is at least partially tubular in the direction of the longitudinal barrel axis and the corresponding inner tube diameter is adapted to the outer circumference of the barrel, so that the barrel can be introduced into the receptacle in the direction of the longitudinal barrel axis when the barrel is mounted on the system housing and can be moved out of the receptacle in the direction of the longitudinal barrel axis when the barrel is disassembled, and wherein the receptacle has a recess which extends in the direction of the longitudinal barrel axis so that the receptacle describes an open annular shape in cross-section perpendicular to the longitudinal barrel axis and in the region of the recess, wherein the barrel is axially fixed with respect to the longitudinal barrel axis by at least one connecting element and rotatably fixed at least in that the mounting rail extends in its longitudinal direction at least partially within the recess of the receptacle.

2. The gun according to claim 1, wherein the fixation with regard to rotation is additionally ensured by the at least one connecting element.

3. The gun according to claim 1, wherein the connecting element is a screw connection.

4. The gun according to claim 1, wherein the receptacle has two edges, and latches on the two edges extend on the recess in the direction of the longitudinal barrel axis and point away from the barrel, in such a way that the receptacle in the region of the latches has the shape and function of a clamp into which the barrel is clamped.

5. The gun according to claim 4, wherein a first of the at least one connecting element comprises a screw comprising a screw head and a bolt having a thread, the bolt extending through one of the latches and through a longitudinal flank of the mounting rail into the mounting rail, the screw head abutting externally against the latches and the thread of the bolt being screwed into a counter inside the mounting rail.

6. The gun according to claim 5, wherein a second connecting element is provided and is arranged opposite the first connecting element with respect to the vertical plane lying in the longitudinal barrel axis.

7. The gun according to claim 6, wherein a total of at least four and an even number of connecting elements are provided, which are arranged in pairs corresponding to the first and the second connecting elements.

8. The gun according to claim 4, wherein the latches of the receptacle bear in a press fit against longitudinal flanks of the mounting rail.

9. The gun according to claim 5, wherein the latches of the receptacle are spaced from longitudinal flanks of the mounting rail so that a press fit between the receptacle and the barrel results only on an outer circumferential surface of the barrel.

10. The gun according to claim 1, wherein the at least one connecting element comprises a screw comprising a screw head and a bolt having a thread, and a counter nut, and the connecting element connects two latches, lying opposite one another with respect to a vertical plane lying in the barrel axis, from the latches situated on the receptacle, wherein the screw head and the counter nut each bear externally against the opposite latches and the bolt is guided through a continuous horizontal bore in the mounting rail extending perpendicularly to the direction of the longitudinal barrel axis.

11. The gun according to claim 10, wherein the latches connected by the connecting element bear in a press fit against longitudinal flanks of the mounting rail.

12. The gun according to claim 10, wherein the latches connected by the connecting element are spaced from longitudinal flanks of the mounting rail so that a press fit between the receptacle and the barrel results only on an outer circumferential surface of the barrel.

13. The gun according to claim 1, wherein the at least one connecting element comprises a screw comprising a screw head and a bolt having a thread, wherein the screw head bears against an outer circumferential surface of the tubular receptacle and the bolt is radially aligned with respect to the longitudinal barrel axis and extends, through the receptacle, into the barrel, wherein the barrel defines a counter-thread for a screw connection with each connecting element.

14. The gun according to claim 13, wherein the at least one connecting element comprises at least two connecting elements, the two connecting elements being distributed in a first plane perpendicular to the longitudinal barrel axis on the outer circumferential surface of the receptacle.

15. The gun according to claim 14, wherein the at least two connecting element comprises four connecting elements, wherein the four connecting elements are present in the plane perpendicular to the longitudinal barrel axis, which connecting elements are distributed on the outer circumferential surface of the receptacle in such a way that each two of them lie opposite one another.

16. The gun according to claim 14, wherein at least one further plane comprising these connecting elements is present plane-parallel to the first plane.

17. The gun according to the claim 13, wherein edges of the receptacle extending on the recess in the direction of the longitudinal barrel axis bear against longitudinal flanks of the mounting rail.

18. The gun according to claim 1, wherein the barrel has a radially outwardly extending projection on its outer surface, and the receptacle has a thread on its tubular outer circumference at a front end portion thereof, wherein on this thread a tube piece provided with an inner thread is screwed, wherein the tube piece has a radially inwardly extending projection in a front region in the longitudinal direction of the barrel, so that the tube piece, guided over the barrel from the front, bears against the projection of the barrel and fixes the barrel in the axial direction by screwing the tube piece onto the thread of the receptacle.

19. The gun according to claim 18, wherein edges of the receptacle extending on the recess in the direction of the longitudinal barrel axis bear against longitudinal flanks of the mounting rail.

* * * * *